US008651874B2

(12) United States Patent
Ku et al.

(10) Patent No.: US 8,651,874 B2
(45) Date of Patent: Feb. 18, 2014

(54) TRANSMISSION LINE WITH ROTATABLE CONNECTOR

(75) Inventors: Ying-Ming Ku, Taoyuan (TW); Chun-Chieh Chen, Taoyuan (TW)

(73) Assignee: YFC-Boneagel Electric Co., Ltd., Taoyuan (TW)

( * ) Notice: Subject to any disclaimer, the term of this patent is extended or adjusted under 35 U.S.C. 154(b) by 372 days.

(21) Appl. No.: 13/101,132

(22) Filed: May 4, 2011

(65) Prior Publication Data

US 2012/0282805 A1 Nov. 8, 2012

(51) Int. Cl.
*H01R 39/00* (2006.01)

(52) U.S. Cl.
USPC ..... 439/31

(58) Field of Classification Search
USPC ..... 439/11, 13, 31, 446, 640, 165
See application file for complete search history.

(56) References Cited

U.S. PATENT DOCUMENTS 1,521,130 A * 12/1924 Schweitzer ..... 362/307
1,961,013 A * 5/1934 Saraceno ..... 439/446
1,981,854 A * 11/1934 Comiskey ..... 439/6
2,540,575 A * 2/1951 Finizie ..... 439/446
3,474,376 A * 10/1969 Preiss ..... 439/31
3,971,900 A * 7/1976 Foley ..... 379/430
4,959,021 A * 9/1990 Byrne ..... 439/310
5,380,219 A * 1/1995 Klier ..... 439/446
5,425,645 A * 6/1995 Skovdal et al. ..... 439/23
5,658,152 A * 8/1997 Selker ..... 439/31
5,735,707 A * 4/1998 O'Groske et al. ..... 439/446
5,882,226 A * 3/1999 Bell et al. ..... 439/582
6,152,639 A * 11/2000 Hsu ..... 403/116
6,406,314 B1 * 6/2002 Byrne ..... 439/215
6,435,409 B1 * 8/2002 Hu ..... 235/441
6,695,620 B1 * 2/2004 Huang ..... 439/11
6,840,795 B1 * 1/2005 Takeda et al. ..... 439/492
6,991,467 B1 * 1/2006 Cheng et al. ..... 439/10
7,025,595 B1 * 4/2006 Chan et al. ..... 439/6
7,066,753 B1 * 6/2006 Tseng ..... 439/259
7,146,667 B2 * 12/2006 Elsener ..... 7/118
7,201,603 B1 * 4/2007 Finona ..... 439/446
7,234,963 B1 * 6/2007 Huang et al. ..... 439/446
7,399,209 B2 * 7/2008 Kodaira ..... 439/640
7,435,090 B1 * 10/2008 Schriefer et al. ..... 439/13
7,445,478 B2 * 11/2008 Chuang ..... 439/165
7,494,343 B2 * 2/2009 Schriefer ..... 439/11

(Continued)

*Primary Examiner* — Neil Abrams
(74) *Attorney, Agent, or Firm* — Chun-Ming Shih; HDLS IPR Services

(57) ABSTRACT

A transmission line with rotatable connector includes an insulated body, a connector a transmission line and a rotatable assembly kit. The insulated body includes a storage space. One end of the insulated body includes an opening slot and the other end of the insulating body includes a sliding slot. The connector is inside of the storage space. One end of the connector protrudes from the opening slot. One end of the transmission line is embedded in the storage space and electronically connected with the connector. The other end of the transmission line protrudes from the insulated body. The rotatable assembly kit includes a rotatable cylinder and a wire cover extending from one side of the rotatable cylinder. The rotatable cylinder is rotatably and pivotally connected to the rear of the connector. The partial transmission line protruding from the insulated body is covered by the wire cover and the partial transmission line horizontally moves along the sliding slot accompany with the rotation of the rotatable cylinder. The transmission line can properly change the direction of the connector to make it convenient for use and also can avoid the breakup of the junction of the transmission line at the bending point.

6 Claims, 4 Drawing Sheets

(56) References Cited

U.S. PATENT DOCUMENTS

| | | | | |
|---|---|---|---|---|
| 7,507,108 | B2 * | 3/2009 | Tsuji | 439/446 |
| 7,510,420 | B2 * | 3/2009 | Mori | 439/446 |
| 7,586,460 | B2 * | 9/2009 | Hunt et al. | 343/882 |
| 7,607,950 | B2 * | 10/2009 | Liao | 439/638 |
| 7,611,378 | B1 * | 11/2009 | Brekosky et al. | 439/500 |
| 7,789,711 | B2 * | 9/2010 | Wu | 439/640 |
| 7,811,136 | B1 * | 10/2010 | Hsieh et al. | 439/640 |
| 7,815,471 | B2 * | 10/2010 | Wu | 439/640 |
| 7,819,403 | B2 * | 10/2010 | Andre | 273/155 |
| 7,824,186 | B2 * | 11/2010 | Zhao et al. | 439/13 |
| 8,070,525 | B2 * | 12/2011 | Hou et al. | 439/660 |
| 8,157,569 | B1 * | 4/2012 | Liu | 439/11 |
| 8,189,101 | B2 * | 5/2012 | Cummings et al. | 348/376 |
| 8,477,505 | B2 * | 7/2013 | Samuels et al. | 361/728 |
| 8,491,318 | B2 * | 7/2013 | Lee et al. | 439/131 |
| 8,499,183 | B2 * | 7/2013 | Lai et al. | 713/340 |
| 2011/0235253 | A1 * | 9/2011 | Samuels et al. | 361/679.02 |
| 2012/0282805 | A1 * | 11/2012 | Ku et al. | 439/586 |

* cited by examiner

TRANSMISSION LINE WITH ROTATABLE CONNECTOR

BACKGROUND

1. Technical Field

The present invention relates to a transmission line. More particularly, the present invention relates to a transmission line with rotatable connector.

2. Related Art

With the development of the technology, all kinds of electronic, communication and multi-media devices, such as computer, cell phone, digital camera, DVD, HD television, have been continuously updated. The electrical signal and message between these products may be transferred by a transmission line. When a transmission line is connected to the port of an electronic device, the signal can be transmitted from an electronic device to another electronic device to get the devices connected.

As known to the public, the transmission line may usually be embedded in the connector at the front end of the body and the electronic terminals inside of the connector may be derived from the rear end of the body to weld with wires. Though plastic injection method is generally used to seal wire with the connector, the junction between wires and connector is usually covered by bended soft material to avoid the breakup of the wires after being repeatedly bended and therefore to avoid the short circuit. However, when the transmission line is repeatedly bended or is bended in one direction for a long period, the junction may break up at the bended place. In addition, the junction of the transmission line usually has non-rotatable structure and when the inserted space or direction has limitation, the junction cannot be inserted properly and causes inconvenience.

BRIEF SUMMARY

The present invention provides a transmission line with rotatable connector in order to properly change the direction of a connector to make it convenient for use.

The present invention provides a transmission line with rotatable connector in order to avoid the breakup of the wires after being repeatedly bended or is bended in one direction for a long period.

The present invention provides a transmission line with rotatable connector comprises an insulated body, a connector, a transmission line and a rotatable assembly kit. The insulated body includes a storage space. One end of the insulated body includes an opening slot and the other end of the insulating body includes a sliding slot. The connector is inside of the storage space. One end of the connector protrudes from the opening slot. One end of the transmission line is embedded in the storage space and electronically connected with the connector. The other end of the transmission line protrudes from the insulated body. The rotatable assembly kit includes a rotatable cylinder and a wire cover extending from one side of the rotatable cylinder. The rotatable cylinder is rotatably and pivotally connected to the rear of the connector. The partial transmission line protruding from the insulated body is covered by the wire cover and the partial transmission line horizontally moves along the sliding slot accompany with the rotation of the rotatable cylinder.

Compared to the known art, the transmission line with rotatable connector of the present invention comprises a rotatable assembly kit. The rotatable cylinder is rotatably and pivotally connected to the rear of the connector. Then the partial transmission line protruding from the insulated body is covered by the wire cover and the partial transmission line horizontally moves along the sliding slot accompany with the rotation of the rotatable cylinder. The transmission line can properly change the direction of the connector to make it convenient for use. The transmission line can also avoid the breakup of the wires from the bending point after being repeatedly bended or is bended in one direction for a long period, thus increases the utility of the present invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Hereinafter, the present invention will be described in detail with reference to the accompanying drawings. It should be understood that drawings do not limit the scope of the present invention.

Figure 1:
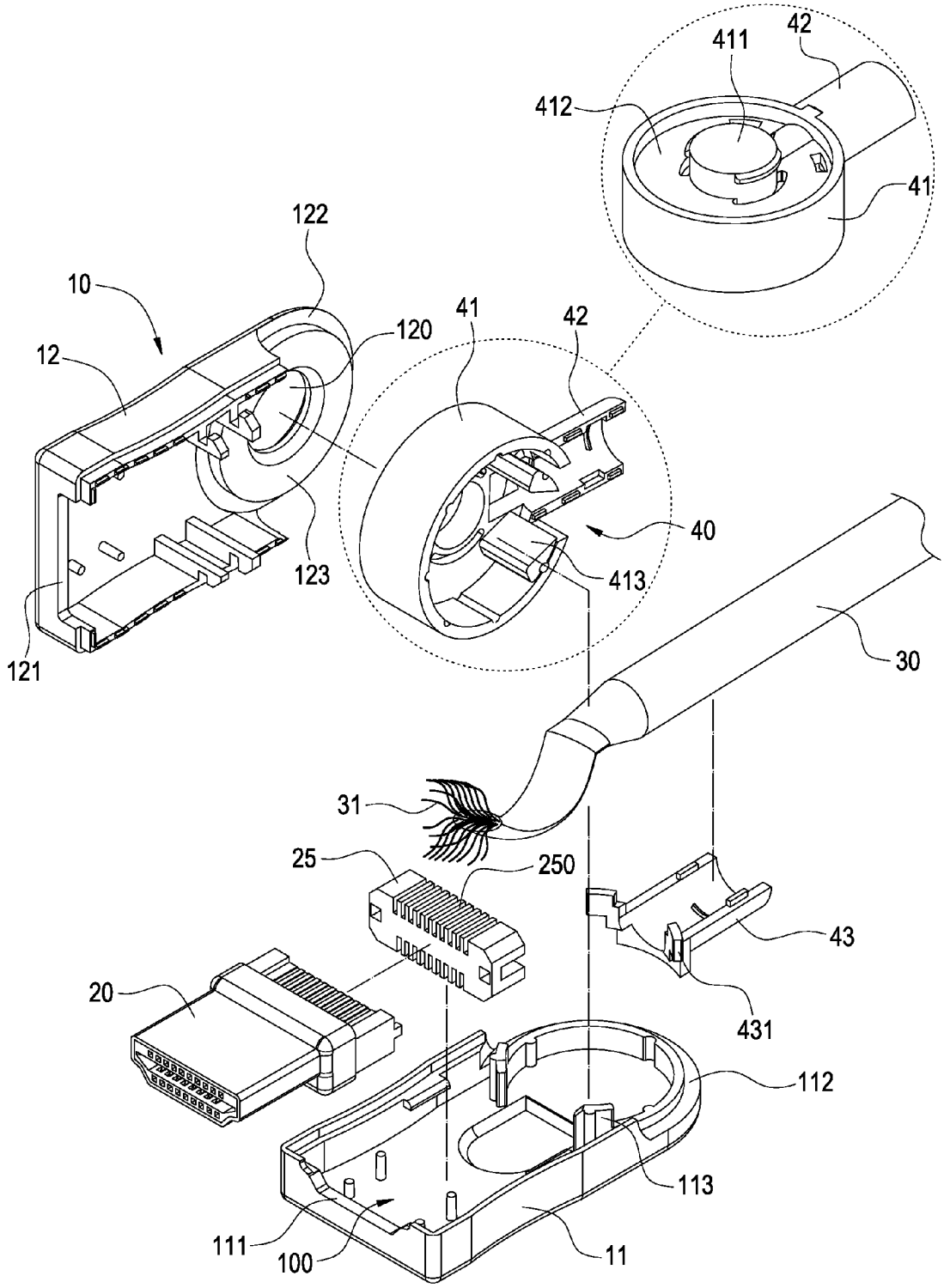
FIG. 1 is a perspective exploded view of one embodiment of a transmission line with rotatable connector.
Figure 2:
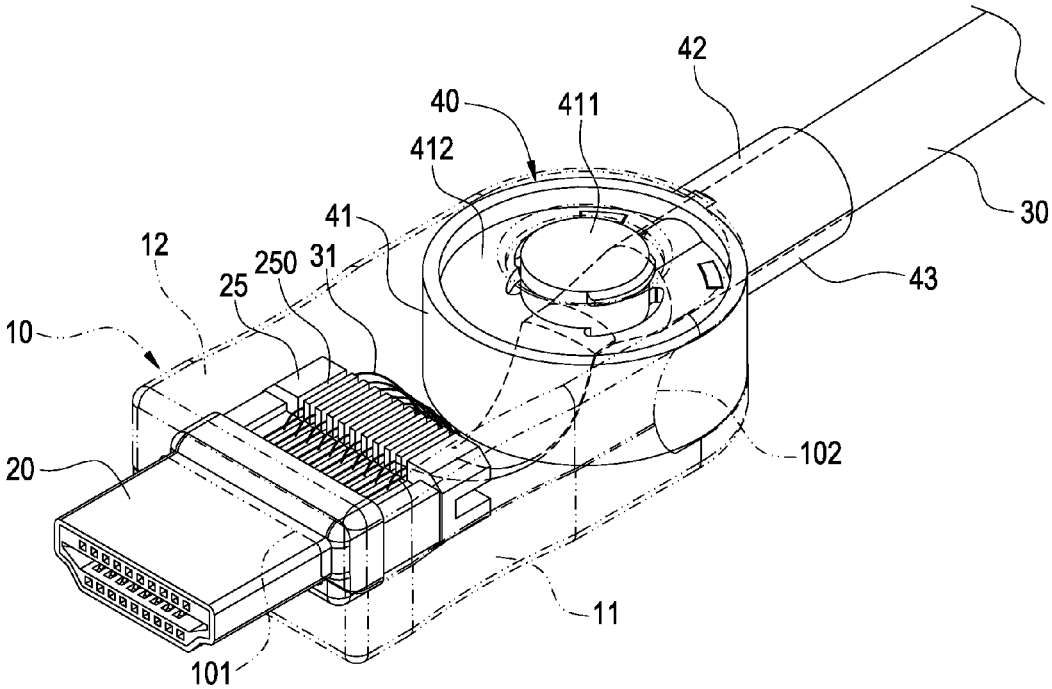
FIG. 2 is one perspective illustration of one embodiment of a transmission line with rotatable connector after assembling.
Figure 3:
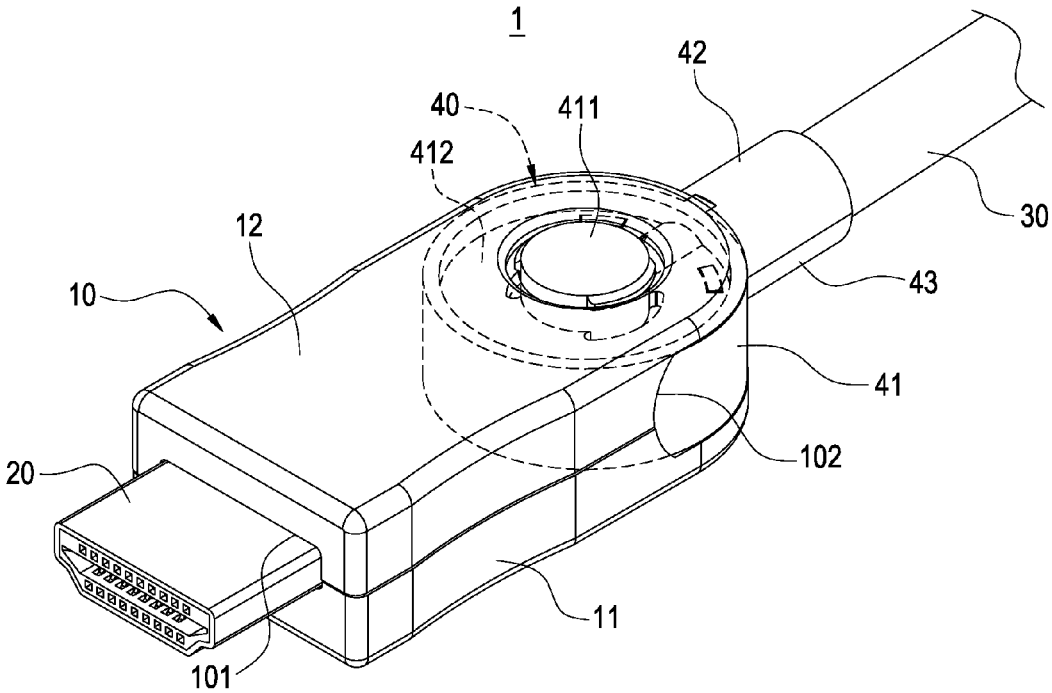
FIG. 3 is another perspective schematic illustration of one embodiment of a transmission line with rotatable connector after assembling.

Please refer to FIG. 1 to FIG. 3, which are respectively the perspective exploded view and two perspective schematic illustrations of one embodiment of a transmission line with rotatable connector. The transmission line with rotatable connector 1 of the present embodiment comprises an insulated body 10, a connector 20, a transmission line 30 and a rotatable assembly kit 40.

The insulated body 10 may include a storage space 100. The front end of the insulated body 10 may have a square shape and the rear end may have a half-ring shape. In addition, one end (front end) of the insulated body may include an opening slot 101 and the other end (rear end) may include a sliding slot 102. In this embodiment, the insulated body 10 may include a base 11 and a cover 12. The base 11 may include a half of the opening slot 111 and a half of the sliding slot 112. The cover 12 may include the other half of the opening slot 121 and the other half of the sliding slot 122. The base 11 and the cover 12 may combine together to form the opening slot 101 from two half opening slots 111 and 121 and to form the sliding slot 102 from two half sliding slots 112 and 122.

The connector 20 may be installed in the storage space 100. One end of the connector may protrude from the opening slot 101 to be engaged with another connector.

A secured base 25 may be installed at the rear of the connector 20. The secured base 25 may include a plurality of grooves 250. One end of the transmission line 30 may be embedded into the storage space and may be electrically connected with the connector 20 while the other end may extend out of the insulated body. The transmission line 30 may include a plurality of wires 31, which may respectively be embedded in the grooves 250 of the secured base 25. In this embodiment, the connector 20 may be a connector with a High-Definition Multimedia Interface (HDMI), which may not limit the scope of the claims.

The rotatable assembly kit 40 may include a rotatable cylinder 41, a wire cover 42 extending from one side of the rotatable cylinder 41 and a supporting base 43. The rotatable cylinder 41 may be rotatably and pivotally connected to the rear of the connector 20. The wire cover 42 may cover the partial transmission line 30 which protrudes from the insolated body 10 and may move horizontally in the sliding slot 102 accompany with the rotation of the rotatable cylinder 41. The supporting base 43 may support the partial transmission line which protrudes from the insolated body 10 and the supporting base 43 may combine with the wire cover 42.

In this embodiment, a plurality of locking apertures may be formed on the inside wall of the wire cover 42. A plurality of locking arms may be formed on the supporting base 43 corresponding to the locking apertures. The locking arms may respectively be secured to the locking apertures 421 to connect the supporting base 43 with the wire cover 42.

The rotatable cylinder 41 may be rotatably and pivotally connected to the connector 20 by opening an aperture 120 on the cover 12 and forming a rotatable column 411 which is pivotally connected with the aperture 120 on the rotatable cylinder 41 in order to make the rotatable cylinder 41 pivotally connected inside of the insulated body 10. After assembling, the rotatable cylinder 41 may partially be protruded and exposed from the sliding slot 102.

In order to make the rotatable cylinder 41 steadily rotate, the inside wall of the cover 12 may be provided with a convex ring 123 extending from the outside rim of the aperture 120. The rotatable cylinder 41 may be correspondently provided with a recess 412 extending from the outside rim of the rotatable column 411. In addition, the base 11 may be provided with a plurality of blocking bars 113 in the storage space 100. A plurality of positioning bars 413 may be provided on the inside wall of the rotatable cylinder 41. As a result, when rotatable cylinder 41 is pivotally connected inside of the insolated body 10, the convex ring 123 may be positioned in the recess 412. The positioning bars 413 may respectively have slide contact with the blocking bars 113 to make the rotatable cylinder 41 rotate more steadily.

Figure 4:
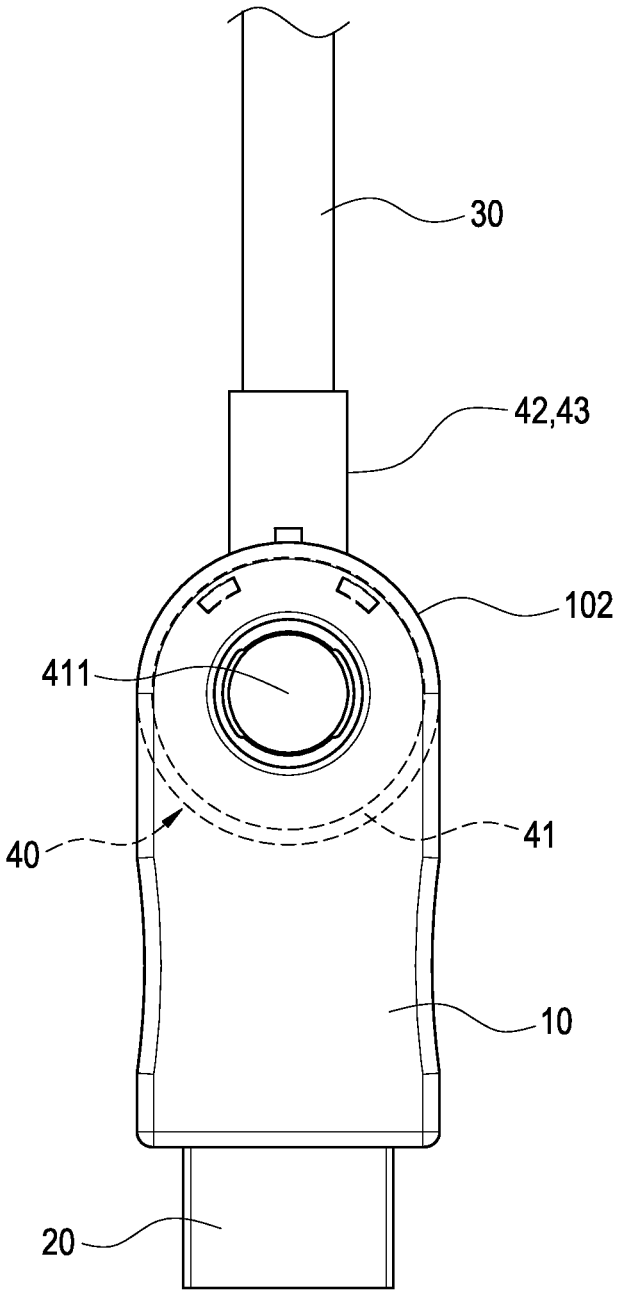
FIG. 4 is a plane schematic illustration of one embodiment of a transmission line with rotatable connector.
Figure 5:
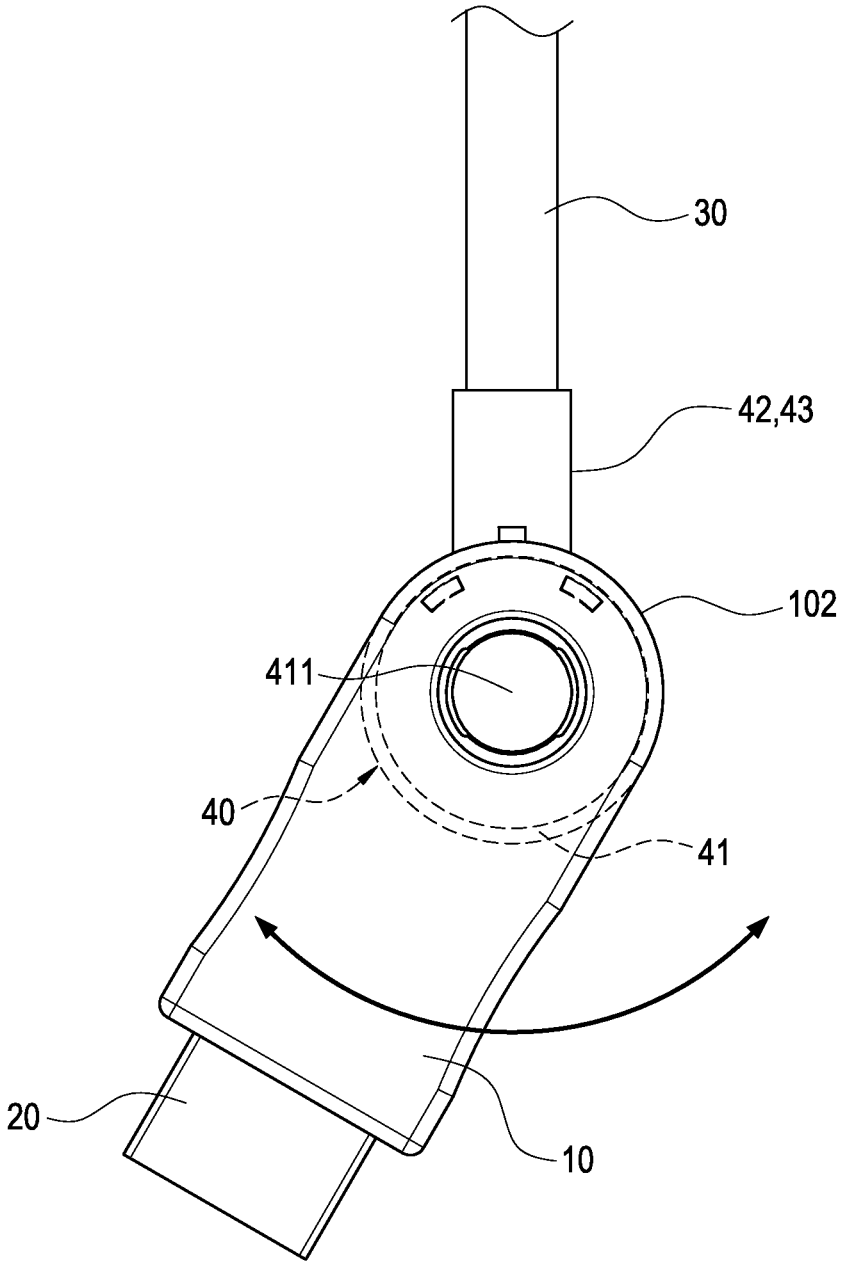
FIG. 5 shows the operation of one embodiment of a transmission line with rotatable connector.

Please refer to FIG. 4 and FIG. 5. FIG. 4 is a plane schematic illustration of one embodiment of a transmission line with rotatable connector. FIG. 5 shows the operation of one embodiment of a transmission line with rotatable connector. When the transmission line with rotatable connector 1 is operated, the rotatable assembly kit 40 is pivotally connected to the rotatable column 411 to make the wire cover 42, the supporting base 43 and the partial transmission line 30 revolve around the rotatable column 411 and make them horizontally move along the sliding slot 102.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A transmission line with rotatable connector, comprising:

an insulating body, including a base and a cover combined together to form a storage space inside, one end of the insulating body including an opening slot and the other end of the insulating body including a sliding slot;

a connector located in the storage space, one end of the connector protruding from the opening slot;

a transmission line, having one end located in the storage space and electronically connected with the connector, and the other end protruding from the insulating body; and a rotatable assembly kit, including a rotatable cylinder and a wire cover extending from one side of the rotatable cylinder, wherein the cover includes an aperture and the inside wall of the cover is provided with a convex ring on an outside rim of the aperture, and the rotatable cylinder includes a column and a recess is formed on an outside rim of the column, so that the rotatable cylinder is rotatably and pivotally connected to the sliding slot by engaging the aperture and the convex ring with the column and the recess, respectively, the wire cover is covered on the transmission line, and the transmission line is capable of horizontally moving along the sliding slot with respect to the rotation of the rotatable cylinder.

2. The transmission line according to claim 1, wherein a half of the opening slot and a half of the sliding slot are formed in the base, the other half of the opening slot and the other half of the sliding slot are formed in the cover, and the base and the cover are combined together to form the opening slot by two half opening slots and form the sliding slot by two half sliding slots.

3. The transmission line according to claim 2, wherein the base is provided with a plurality of blocking bars in the storage space, the inside of the rotatable cylinder is correspondingly provided with a plurality of positioning bars, and the positioning bars respectively have slide contact with the blocking bars to make the rotatable cylinder rotate steadily in the insulating body.

4. The transmission line according to claim 1, further comprising a secured base at the rear of the connector, wherein the secured base includes a plurality of grooves, the transmission line includes a plurality of wires, the wires are respectively embedded in the grooves.

5. The transmission line according to claim 1, wherein the rotatable cylinder is partially protruded and exposed at the sliding slot.

6. The transmission line according to claim 1, wherein the rotatable assembly kit further includes a supporting base, the supporting base together with the wire cover support the transmission line protruding from the insulating body.

* * * * *